US010706661B2

(12) United States Patent
Froy

(10) Patent No.: US 10,706,661 B2
(45) Date of Patent: Jul. 7, 2020

(54) AUGMENTED REALITY SPORTS BETTING AND AUGMENTED REALITY FEATURES

(71) Applicant: IGT, Las Vegas, NV (US)

(72) Inventor: David Froy, Lakeville-Westmorland (CA)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 16/193,252

(22) Filed: Nov. 16, 2018

(65) Prior Publication Data

US 2020/0160648 A1 May 21, 2020

(51) Int. Cl.
*G07F 17/32* (2006.01)

(52) U.S. Cl.
CPC ..... *G07F 17/3211* (2013.01); *G07F 17/3244* (2013.01); *G07F 17/3288* (2013.01)

(58) Field of Classification Search
CPC ..... G07F 17/32; G07F 17/3211
See application file for complete search history.

(56) References Cited

U.S. PATENT DOCUMENTS

2014/0121015 A1* 5/2014 Massing ..... G07F 17/3211 463/33
2015/0287265 A1* 10/2015 Lyons ..... G07F 17/3244 463/25
2016/0093154 A1* 3/2016 Bytnar ..... G07F 17/3218 463/25
2017/0046906 A1 2/2017 Hilbert et al.
2019/0122500 A1* 4/2019 Joao ..... G07F 17/3288

* cited by examiner

*Primary Examiner* — Reginald A Renwick
(74) *Attorney, Agent, or Firm* — Sheridan Ross P.C.

(57) ABSTRACT

The present disclosure relates generally to use of and interaction with a wearable device comprising a wireless communications interface, an augmented reality display, an input device, a processor coupled with the wireless communications interface, the display, and the input device, and a memory coupled with and readable by the processor. The memory can store therein a set of instructions which, when executed by the processor, causes the processor to receive, through the wireless communications interface from a gaming system of a gaming venue, information related to a competitive event. The processor can present, through the augmented reality display, a menu comprising a set of options related to the competitive event, receive, from the input device an input indicating a selected option from the set of options related to the competitive event, and send, to the gaming system of the gaming venue, a message comprising information related to the selected option.

17 Claims, 9 Drawing Sheets

AUGMENTED REALITY SPORTS BETTING AND AUGMENTED REALITY FEATURES

BACKGROUND

Embodiments of the present disclosure relate generally to augmented reality systems and more particularly to providing augmented reality sports betting and augmented reality features related to services of a gaming venue.

In a casino or other gaming venue, the sports book portion of the venue is typically separate from a gaming portion of the venue were various electronic games, table games, etc. are located. Therefore, a player who is interested in a particular sporting event is often left with a choice between watching a game or other sporting event of interest or playing table or electronic games. Additionally, this choice limits revenues of the gaming venue since players who choose to watch a game or event of interest in the sports book portion of the venue are not spending money on table or electronic games during that time.

BRIEF SUMMARY

According to one embodiment, a wearable device can comprise a wireless communications interface, an augmented reality display, an input device, a processor coupled with the wireless communications interface, the display, and the input device, and a memory coupled with and readable by the processor. The memory can store therein a set of instructions which, when executed by the processor, causes the processor to receive, through the wireless communications interface from a gaming system of a gaming venue, information related to a competitive event. The processor can present, through the augmented reality display, a menu comprising a set of options related to the competitive event, receive, from the input device an input indicating a selected option from the set of options related to the competitive event, and send, to the gaming system of the gaming venue, a message comprising information related to the selected option.

According to another embodiment, a system can comprise a communications interface coupled with a communications network, a processor, coupled with the communication interface, and a memory coupled with and readable by the processor. The memory can store therein a set of instructions which, when executed by the processor, causes the processor to send, through the communications interface to a wearable device, information related to a game, receive, through the communications interface from the wearable device, a message comprising information related to a wager on an outcome of the game, and provide, to the wearable device through the wireless communication interface, information comprising a real-time update of a status of the game.

According to yet another embodiment, a method can comprise receiving, by a wearable device from a gaming system of a gaming venue, information related to a game provided within the gaming venue. The wearable device can present, through an augmented reality display, a menu comprising a set of options related to the game and receive an input indicating a selected option of the set of options related to the game. The wearable device can then send, to the gaming system of the gaming venue, a message comprising information related to the selected option.

Additional features and advantages are described herein and will be apparent from the following Description and the figures.

DETAILED DESCRIPTION

Embodiments of the present disclosure will be described in connection with a wearable, augmented reality device. Through such a device, a user may access and interact with various aspects of a gaming venue. For example, the user may access a sports book or other gaming system of the venue, obtain information about available or upcoming games, sporting events, etc., place wagers on such events, view real time status updates on the event while it is occurring live, and obtain the results of the event and wagers placed thereon. Additionally, or alternatively, the user may access, through the wearable device, various services of the gaming venue. For example, the user may view a menu for a restaurant in the gaming venue and order food or drinks or make a reservation. Other features and functions of various embodiments will be described herein.

Figure 1:
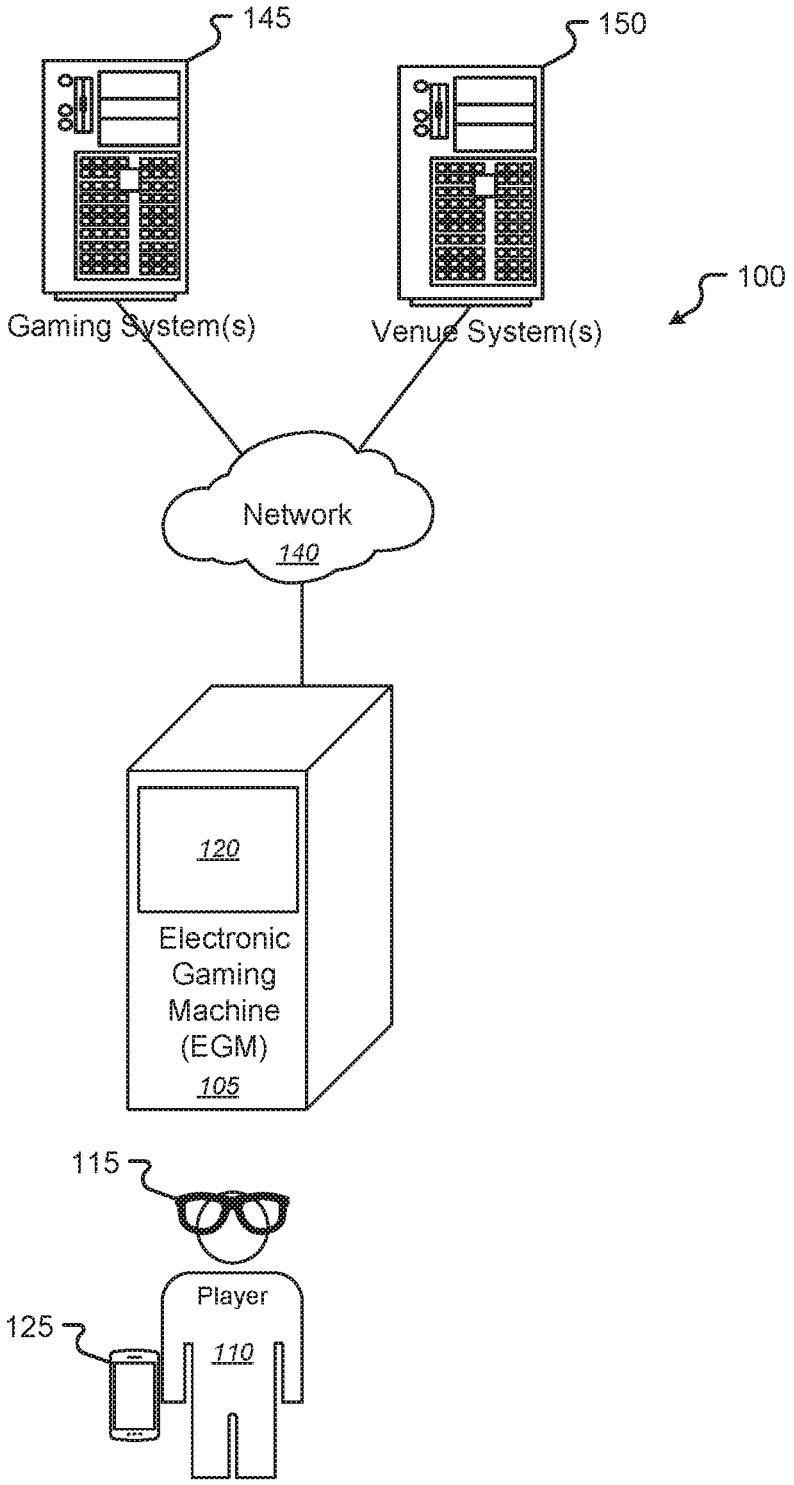
FIG. 1 is a block diagram illustrating an exemplary system for augmented reality sports betting and providing augmented reality features related to a gaming venue according to one embodiment of the present disclosure.

FIG. 1 is a block diagram illustrating an exemplary system for augmented reality sports betting and providing augmented reality features related to a gaming venue according to one embodiment of the present disclosure. As illustrated in this example, such a system 100 can comprise an Electronic Gaming Machine (EGM) 105 and a player 110. The EGM 105 can comprise, for example, any type of electronic device providing an electronic version of a game of chance including, but not limited to, video poker, video roulette, video black jack, video craps, video slots, video bingo, video pachinko, etc. It should be understood that, while one EGM 105 and one player 110 are illustrated here for the sake of simplicity and for illustrative purposes only, any number of EGMs 105 may be employed, for example in a casino, and these machines can be accessed and utilized by any number of players 110 at any given time.

The system 100 can also include a wearable device 115 such as a headset worn by the player 110. The wearable device 115 can connect to the EGM 105 using a wireless connection, e.g., WIFI such as IEEE 802.11n, 802.11ac, or similar, Bluetooth 4.0, 5.0, or similar, or other wireless communications. The wearable device 115 can include a microprocessor and screen, such as a transparent or semi-transparent lens onto which a holographic image can be projected, and which can cover one or both eyes of the player 110.

When the player 110 is in proximity to the EGM 105 wearing the wearable device 115, the player 110 can be given the option to pair the device 115 with the EGM 105. For example, this option can comprise a prompt presented on a display 120 of the EGM 105 or the display of the wearable device 115. To pair with the wearable device 115, the EGM 105 can generate and provide a one-time code that represents the EGM 105. This code can be provided by the EGM 105 to the wearable device 115 over the wireless connection or can be presented on the display 120 of the EGM 105 to be input into the wearable device. For example, the wearable device 115 can include a camera capturing a front-facing view of the player 110 when the device 115 is being worn by the player 110. This camera, when the wearable device 115 is pointed towards the display 120 of the EGM 105 can capture the code and the wearable device 115 can read and capture the code. In other cases, the player 110 may input the code into the device, e.g., by speaking the code in cases where the wearable device 115 is equipped with a microphone and speech recognition capabilities, by hand gestures, e.g., "pressing" keys of a virtual keypad projected onto the display of the wearable device 115, by inputting or scanning the code with a mobile device 125 paired with the wearable device 115, etc. In yet other cases, the code can comprise a serial number or other unique identifier printed on the EGM 105 itself, such as in the form of a barcode or QR code, and the player 110 can input the code by scanning it with their mobile device 125, looking at it through the wearable device 115, etc. According to one embodiment, this code, once input to the wearable device 115, can then be used as a key to encrypt/decrypt communications between the EGM 105 and wearable device 115.

According to one embodiment, the EGM 105 can be coupled with a communication network 140. For example, each EGM 105 in a casino or other venue may be coupled with a wired or wireless Local Area Network (LAN). Through this network, the EGM 105 can communicate with various back office systems such as a banking system, for example. As illustrated in this example, a gaming system 145 can be coupled with the communication network 140. The gaming system 145 can comprise one or more servers providing a number of different functions. For example, the gaming system 145 can operate a sports book through which players can place bets on various sporting and other competitive events including, but not limited to, football, baseball, basketball, hockey, horse races, boxing, mixed martial arts fights, etc. In yet other cases, the gaming system 145 can provide games not available through the EGM such as keno. In any of these cases, the player 110 can access functions of the gaming system 145 through the EGM 105 once the wearable device 115 is paired with the EGM 105.

According to another embodiment, the user may access the gaming system 145 via the network 140 without involving the EGM 105. For example, the network 140 can comprise a WiFi or other wireless network. In such cases, rather than pairing with the EGM 105, as described above, the wearable device 115 can connect with the gaming system 145 in a similar manner via the network 140. When the player 110 enters the gaming venue wearing the wearable device 115, the wearable device 115 can detect this network 140 and the player 110 can be given the option to connect to the network 140. For example, this option can comprise a prompt presented on a display 120 of the EGM 105 or the display of the wearable device 115. Upon connection to the network 140, the wearable device 115 can then launch applications executing thereon and as will be described in greater detail below, which allow the wearable device to access and interact with various functions of the gaming system 145. In yet another case, the wearable device 115 may first connect with the gaming system 145 through the EGM 105 and then switch to the network 140 for continued access to the gaming system 145 even when away from the EGM 105.

In this way, the wearable device 115 can access the functions of the gaming system 145 without first connecting with and being tied to an EGM 105. Therefore, the player 110 can place sports bet and wagers anywhere in the gaming venue. However, in some cases, the player 110 can be geo-fenced into a certain area to make sure they are not placing wagers where they are not allowed depending on local laws and/or regulations. For example, by determining a current location of the player 110 based on WiFi signal triangulation, a GPS location detected by the wearable device 115, and/or other means of determining location, access to the gaming system 145 or the ability to place wagers through the gaming system 145 to limit to certain physical location in the venue, e.g., a sports book area of a casino. In other cases, the player 110 may not be restricted in this way can place wagers through the gaming system 145 while playing an EGM 105, at a table game. or at a bar or restaurant.

As illustrated in this example, the system 100 can also comprise a venue system 150. As with the gaming system 145, the venue system can comprise one or more servers providing a number of different functions. For example, the venue system can provide services and functions for accessing information related to services provided within a gaming venue including, but not limited to, restaurants, bars, hotel accommodations, valet parking, various concierge services, etc. As with the gaming system 145, the wearable device 115 can access the services of the venue system through the EGM 105, once paired therewith, or directly though the network 140, without first pairing with the EGM 105.

In use, once the wearable device 115 is connected with the EGM 105 or gaming system 145, the player 110 can be presented with a heads-up menu displayed in the wearable device 115 which allows the player 110 to view different competitive events such as real-time sports event, races, and games that are taking place. The player 110 can then make a selection of one of the competitive events using a gesture or by using a touch pad or other input device on the wearable device 115. The player 110 can then select an option related to the selected competitive event such place a wager, check running wagers, view results, etc. The player 110 can also navigate back to the main menu and make a different selection. Once the competitive event begins and as it progresses, the player can be presented with real-time status updates through the wearable device 115 in a textual, graphic, or other format. For example, with a horse race or dog race, the wearable device 115 can present a virtual track updated in real time as the race progresses. The participants of the race can appear on the virtual track with a tracking number or name to indicate where they are in the race. In other instances, the real-time updates can comprise presenting a live audio or video stream of the competitive event through the wearable device 115. The stream can broadcast through the gaming server 145, accessed over the Internet through the network, broadcast over-the-air from a broadcaster, etc. Additionally, or alternatively, when the competitive event is finished, the player 110 can be notified of the result through the wearable device 115 and can be awarded a prize based on any wagers made and the result of the competitive event.

According to one embodiment, the player 110 can also be presented, through the menu displayed in the wearable device 115, an option to play a game available through the EGM 105, gaming system 145, or other systems of the venue. For example, the player 110 may be presented with an option to play a keno game. Once selected through a gesture or other input to the wearable device 115, the player 110 can further pick either random picks or manually pick numbers. While the player 110 is in the venue, when a number is picked, a notification can be sent from the EGM 105, gaming system 145, or other system operating the keno game to the wearable device 115 to alert the player 110 of the number. This notification can be presented in the wearable device 115 in a variety of ways. For example, a graphical representation of the player's keno card can be presented in the display of the mobile device 115 along with a representation of the selected number and an indication of whether the selected number matches a number picked by the player 110. Similarly, once the keno game is over, the player 110 can be presented with a notification through the wearable device 115. For example, the wearable device 115 can display a popup to alert the player 110 and let him know if he won.

According to one embodiment, the mobile device 125 of the player 110 or the wearable device 115 may execute a mobile wallet or banking application. Such an application can be used to store an indication of credits available to the player 110. Since this application maintains information uniquely identifying the player 110, e.g., an account number etc., it can be used by the EGM 105, gaming system 145, or other systems of the venue to authenticate the player 110. Additionally, or alternatively, the application can also be used to transfer credits, i.e., money, to the EGM 105 or gaming system 145 for game play and to place wagers of for cash out, e.g., though the EGM 105 or other system of the venue.

According to one embodiment, the wearable device 115 can also, based on information from the venue system 150, for example, display ads for in-venue events and features such as shows, upcoming table game tournaments, EGM tournaments, restaurant menus, etc. Through the wearable device 115 the player 110 can view and select such available services, events, etc. and, for example, order a drink from the bar and have it delivered. In such a case, the player can also pay for the drink through the mobile wallet or banking application executing on the wearable device 115 or mobile device 125. In another example, the player 110 can reserve a table at a restaurant or buffet in the venue by selecting that option through the wearable device 115. In such a case, the venue system 150 may provide and the wearable device 115 can display a notification when the time for the reservation comes up. Further, the wearable device 115 can present, through the display, a set of directions to a location in the gaming venue for the restaurant, e.g., in the form of turn-by-turn navigation instruction overlays.

Additionally, or alternatively, the wearable device 115 can maintain a user profile storing preferences or history information for the player 110. The wearable device 115 may also provide a menu or other interface through which the player 110 can setup or modify this profile, for example, to identify a set of favorite teams or sports to follow. Based on this profile, the wearable device 115 can generate recommendations for new games, upcoming competitive events, available services of the venue, etc. Once a recommendation is selected, the wearable device can present directions to a location of an open game or an EGM providing the selected game. Once at the location, the wearable device can then present, for example in a textual or graphical overlay in the display of the wearable device 115, instructions on how to play the game.

Figure 2A:
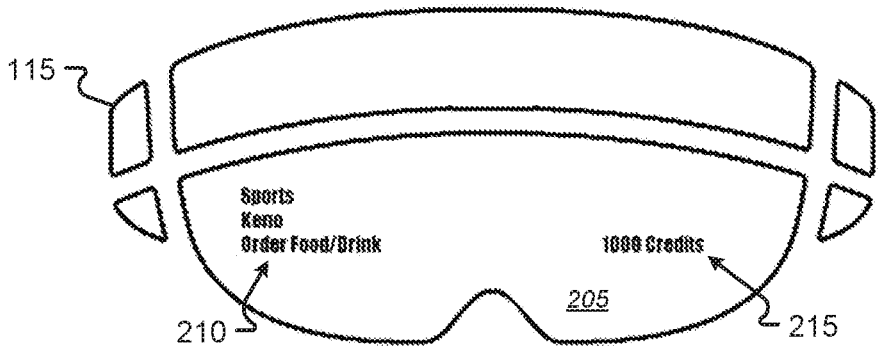
FIGS. 2A-2D illustrate exemplary user interface displays of a wearable device according to embodiments of the present disclosure.

FIG. 2A illustrates an exemplary user interface display of a wearable device according to embodiments of the present disclosure. As illustrated in this example, a display 205 of the wearable device 115 can present a menu 210 of options based on information received from the EGM 105, gaming system 145, venue system 150, or other systems of the venue. As illustrated here, this menu 210 includes options for viewing current or upcoming competitive events ("Sports"), games available in the venue ("Keno"), and available services of the venue ("Order Food/Drink"). As illustrated here, the display 205 can also include a representation 215 of available game play credits for the player 110, i.e., an available balance from the player's mobile wallet or banking application. As noted above, the player can select one of these options by hand gestures, e.g., "pressing" or "tapping" the menu option, by manipulating an input device on the wearable device. Additionally, or alternative, the wearable device 115 may implement speech recognition functions and the player may select the menu options by voice commands.

Figure 2B:
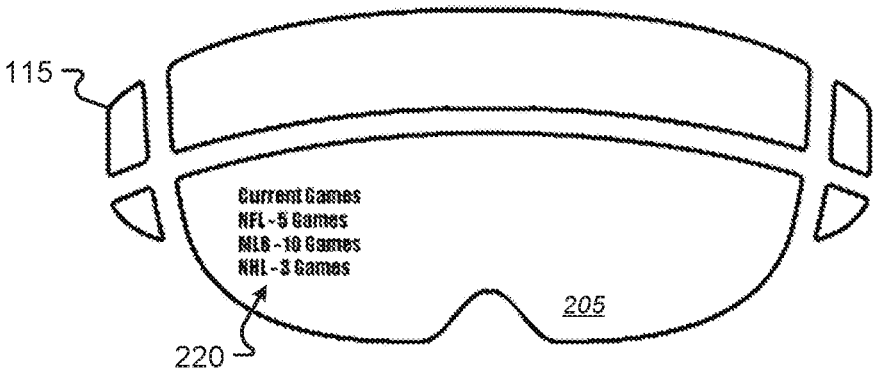

FIG. 2B illustrates the display 205 of the wearable device 115 updated after the player 110 has selected a menu option. More specifically, once the player has selected the competitive events or "Sports" options represented in FIG. 2A, the display 205 has been updated to present another menu 220 of further options. This menu 220 represents the different types of sports and number of games available for each sport.

Figure 2C:
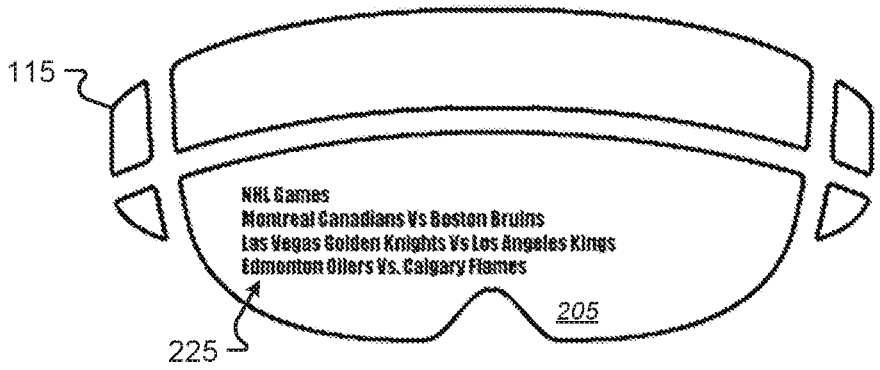

Similarly, FIG. 2C illustrates the display 205 of the wearable device 115 updated after the player 110 has selected a menu option as presented in FIG. 2B. In this case, the player 110 selected "NHL Games" from the menu represented in FIG. 2B and the display 205 of FIG. 2C has been updated to present a new menu 225 listing as options the available games for that sport. Again, the player 110 can select one of these options by hand gestures, voice commands, manipulating an input device of the wearable device 115, etc.

Figure 2D:
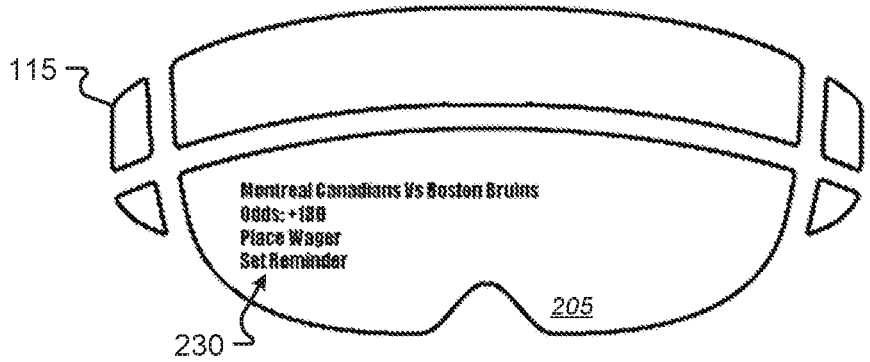

Once an option or game of this menu 225 has been selected, the display 205 of the wearable device 115 can be updated again as illustrated by FIG. 2D. Here, another menu 230 of options and additional information can be presented through which the player can view odds for the selected game, choice to place a wager, set a reminder for the start of the game, etc. Once the game starts, as noted above, real-time updates of the status of the game, e.g., score, time remaining, textual or graphical play-by-play updates, an audio stream, a video stream, etc. may be presented in the display 205. Additionally, or alternatively, when the game ends, the result of the game, e.g., the final score, can be presented in the display along with a result of any wager made by the player 110 on that game.

Figure 3:
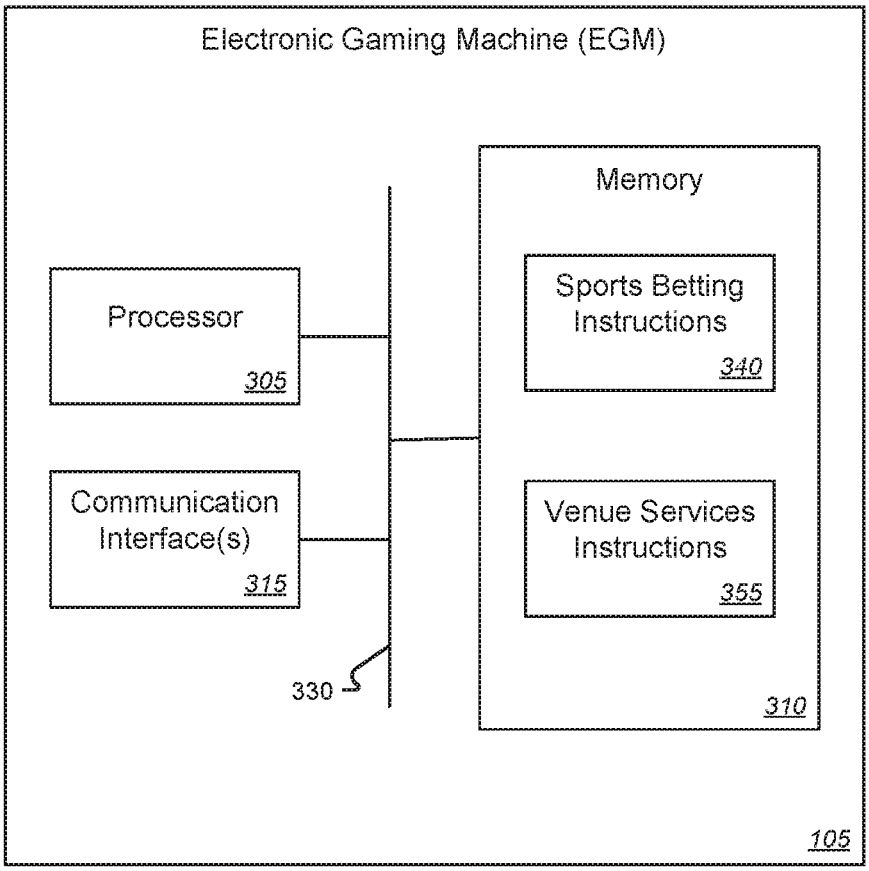
FIG. 3 is a block diagram illustrating additional details of an exemplary electronic gaming machine according to one embodiment of the present disclosure.

FIG. 3 is a block diagram illustrating additional details of an exemplary electronic gaming machine according to one embodiment of the present disclosure. As illustrated in this example, an EGM 105 can comprise a processor 305. The processor 305 may correspond to one or many computer processing devices. For instance, the processor 305 may be provided as silicon, as a Field Programmable Gate Array (FPGA), an Application-Specific Integrated Circuit (ASIC), any other type of Integrated Circuit (IC) chip, a collection of IC chips, or the like. As a more specific example, the processor 305 may be provided as a microprocessor, Central Processing Unit (CPU), or plurality of microprocessors that are configured to execute the instructions sets stored in a memory 310. Upon executing the instruction sets stored in memory 310, the processor 305 enables various functions of the EGM 105 as described herein.

A memory 310 can be coupled with and readable by the processor 305 via a communications bus 330. The memory 310 may include any type of computer memory device or collection of computer memory devices. Non-limiting examples of memory 310 include Random Access Memory (RAM), Read Only Memory (ROM), flash memory, Electronically-Erasable Programmable ROM (EEPROM), Dynamic RAM (DRAM), etc. The memory 310 may be configured to store the instruction sets depicted in addition to temporarily storing data for the processor 305 to execute various types of routines or functions.

The processor 305 can also be coupled with one or more communication interfaces 315 via the communications bus 330. The communication interfaces 315 can comprise, for example, a Bluetooth, WiFi, or other type of wireless communications interface. In some cases, the communication interfaces can also include an interface for communicating via a wired or wireless LAN.

The memory 310 can store therein sets of instructions which, when executed by the processor 305, cause the processor 305 to provide augmented reality sports betting and augmented reality features related to a gaming venue. More specifically, the memory can store a set of sports betting instructions 340 which can cause the processor 305 to send, through the communications interface 315 to a wearable device 115, information related to a game. The game can comprise, for example, a Keno game or similar casino game. In other cases, the information can be related to a sporting event or other competitive event. This information can be obtained by the processor 305 from a gaming system 145 or other system of the venue through the communications interface 315. The sports betting instructions 340 can further cause the processor 305 to receive, through the communications interface 315 from the wearable device 115, a message comprising information related to a wager on an outcome of the game. Once the game begins and as it progresses, the sports betting instructions 340 can cause the processor 305 to provide, to the wearable device 115 through the wireless communication interface 315, information comprising a real-time update of a status of the game. In some cases, this information can also be obtained by the processor 305 from a gaming system 145 or other system of the venue through the communications interface 315. The information comprising the real-time update of the status of the game can additionally, or alternatively, comprise a notification that the game has concluded along with an indication of a result of the game.

The memory 310 can also store a set of venue services instructions 355 which, when executed by the processor 305, can further cause the processor 305 to provide, to the wearable device 115 through the communication interface 315, information related a service of a venue related to the system. This information can be obtained by the processor 305 from a venue system 150 or other system of the venue through the communications interface 315 and can comprise, for example, ads for in-venue events and features such as shows, upcoming table game tournaments, EGM tournaments, restaurant menus, etc. The venue services instructions 355 can further cause the processor to receive, from the wearable device 115 through the communication interface 315, a request for the service of the venue, e.g., a request for a restaurant reservation. In some cases, the processor 305 may forward this request to the venue system 150 through the communication interface 315 for further processing of the request. The venue services instructions 355 can further cause the processor 305 to provide, to the wearable device 115 through the communication interface 315, a notification of an event of a venue related to the system. For example, the notification can comprise notification of an upcoming game or tournament in the venue. This notification can be provided, for example, based on information obtained by the processor 305 from the venue system 150 through the communication interface 315.

Figure 4:
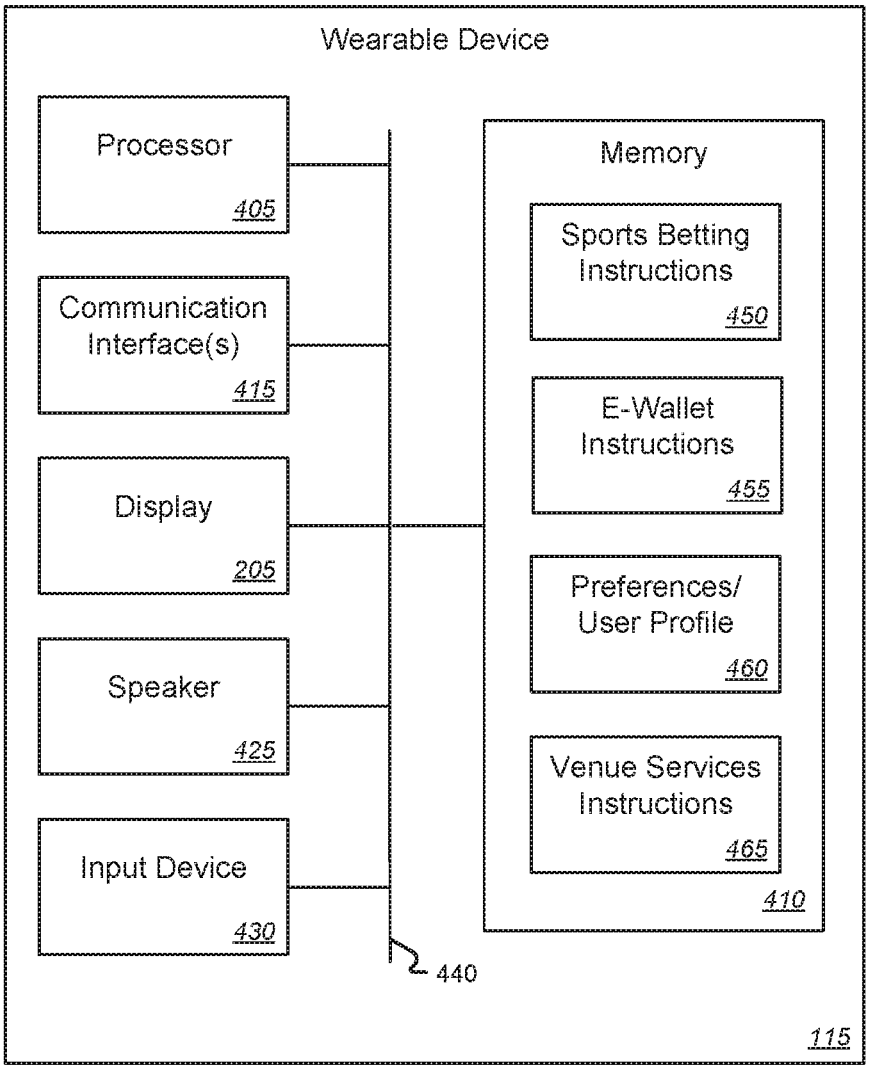
FIG. 4 is a block diagram illustrating additional details of an exemplary wearable device according to one embodiment of the present disclosure.

FIG. 4 is a block diagram illustrating additional details of an exemplary wearable device according to one embodiment of the present disclosure. As illustrated in this example, a wearable device 115 can comprise a processor 405 such as any of the various types of processors described above. A memory 410 can be coupled with and readable by the processor 405 via a communications bus 440. The memory 410 can comprises any one or more of the different types of volatile and/or non-volatile memories described above. The processor 405 can also be coupled with one or more communication interfaces 415 and a display 420 via the communications bus 440. The communication interfaces 415 can comprise, for example, a Bluetooth, WiFi, or other type of wireless communications interface. The display 420 can comprise, for example, a transparent or semi-transparent lens onto which a holographic image can be projected, and which can cover one or both eyes of the player 110.

The memory 410 can store therein sets of instructions which, when executed by the processor 405, cause the processor 405 to provide augmented reality sports betting and augmented reality features related to a gaming venue. More specifically, the memory can store a set of sports betting instructions 340 which, when executed by the processor 405, cause the processor 405 to receive, through the wireless communications interface 415 from a gaming system 145 of a gaming venue, information related to a competitive event, present, through the display 205, a menu comprising a set of options related to the competitive event, and receive, from an input device 430 an input indicating a selected option from the set of options related to the competitive event. According to one embodiment, the memory 410 of the wearable device 115 can store therein a user profile 460 for a user of the wearable device 115. The user profile can define a set of preferences for the user, e.g., favorite games, favorite sports teams or players, etc. Accordingly, the sports betting instructions 450 can further cause the processor 405 of the wearable device 115 to update the user profile 460 based on the received selection.

The selected option can comprise an option to place a wager on an outcome of the competitive event. According to one embodiment, the memory can also store therein a set of e-wallet instructions 455. The e-wallet instructions 455, when executed by the processor 405, can cause the processor to maintain information indicating an available game play credit for a user of the wearable device 115. The information related to the selected option can comprise an amount of the wager from the available game play credit for the user of the wearable device 115. Accordingly, the e-wallet instructions 455 can cause the processor 405 to decrement the information indicating the available game play credit for the user of the wearable device by at least the amount of the wager. The sports betting instructions 450 can then cause the processor 405 to send, to the gaming system 145 through the communications interface 415, a message comprising information related to the selected option.

Once the competitive event has started and while it is being conducted, the sports betting instructions 450 can cause the processor 405 to receive, from the gaming system 145 through the communication interface 415, information comprising a real-time update of a status of the competitive event and present, through the display 205, the received information comprising the real-time update of the status of the competitive event. For example, the information comprising the real-time update of the status of the competitive event comprises a live video stream presented on the display 205, an audio stream played through a speaker 425, or other textual or graphical indications. Additionally, or alternatively, the sports betting instructions 450 can cause the processor 405 to receive, from the gaming system 145 through the communication interface 415, a notification of the outcome of the competitive event and present, through the display 205, an indication of the outcome of the competitive event. The e-wallet instructions 455 can further cause the processor 405 to modify the information indicating the available game play credit for the user of the wearable device based on the outcome of the competitive event and the wager placed on the outcome. For example, if the user wins the wager based on the outcome of the competitive event, the available credits can be incremented to reflect the winnings amount of the wager. In other cases, if the wager is not payable until conclusion of the event and the user loses the wager, the available credits can be decremented accordingly.

Based on the preferences and other information of the user profile 460, the sports betting instructions 450 can cause the processor 405 of the wearable device 115 to provide to the user through the display 205 information regarding an upcoming event of potential interest to the user. For example, the processor 405 can obtain from the gaming system 145 through the communications interface 415 information about available games and competitive events and present an indication to the user through the display 205 when a favored game is available, team is playing, etc. The sports betting instructions 450 can cause the processor 405 to present the information through the display 205 and receive from the input device 430 an indication of selection of the information or generated recommendation by the user of the wearable device. For example, the selection may indicate a request for a game. The sports betting instructions 450 can then cause the processor 405 send, to the gaming system 145 through the communications interface 415, a message requesting the game and receive a notification when the requested game is available. In some cases, and according to one embodiment, the sports betting instructions can cause the processor to present, through the display 205, a set of instructions for the game.

The memory 410 can also store therein a set of venue services instructions 465 which, when executed by the processor 405, cause the processor to receive, through the communication interface 415, information of available services from the venue systems 150. The venue services instructions 465 can further cause the processor 405 to generate a recommendation of a service of the gaming venue for the user based on the user profile 460. The venue services instructions 465 can cause the processor 405 to present the information or recommendations through the display 205 and receive through the input device 430 an indication of selection of the information or generated recommendation by the user of the wearable device 155. For example, the selection may indicate an order of food or drink or a request for a reservation at a restaurant or gaming table, etc. The venue services instructions 465 can then cause the processor 405 to send, to the venue system 150 through the communications interface 415, a message requesting the service of the gaming venue and receive a notification when the requested service of the gaming venue is available. In some cases, and according to one embodiment, the venue services instructions 465 can further cause the processor 405 to generate and present, through the display 205, directions to a location in the gaming venue for the requested service, e.g., in the form of turn-by-turn navigation instruction overlays in the augmented reality display 205 to guide the user to the selected bar, restaurant, game, etc.

Figure 5:
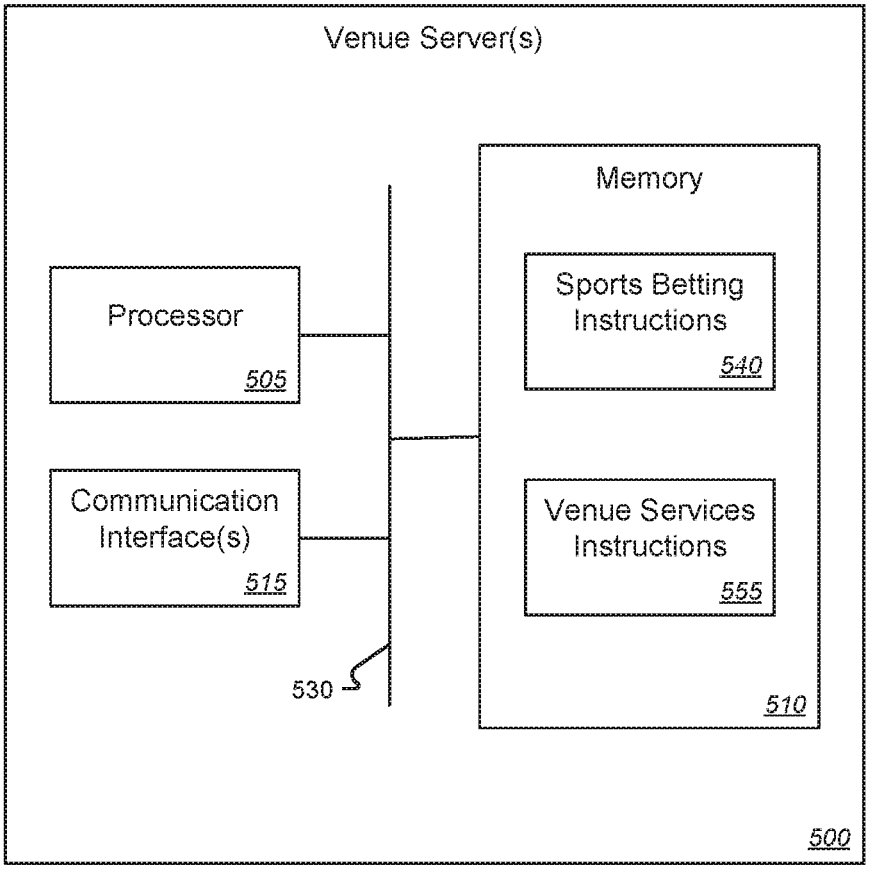
FIG. 5 is a block diagram illustrating additional details of an exemplary gaming venue system according to one embodiment of the present disclosure.

FIG. 5 is a block diagram illustrating additional details of an exemplary gaming venue system according to one embodiment of the present disclosure. As illustrated in this example, a server 500, such as may implement the gaming system 145 or the venue system 150 described above can comprise a processor 505 such as any of the various types of processors described above. A memory 510 can be coupled with and readable by the processor 505 via a communications bus 530. The memory 510 can comprises any one or more of the different types of volatile and/or non-volatile memories described above. The processor 505 can also be coupled with one or more communication interfaces 515 via the communications bus 530. The communication interfaces 515 can comprise, for example, a Bluetooth, WiFi, or other type of wireless communications interface.

The memory 510 can store therein sets of instructions which, when executed by the processor 505, cause the processor 505 to provide augmented reality sports betting and augmented reality features related to a gaming venue. More specifically, the memory 510 can store a set of sports betting instructions 540 which can cause the processor 505 to send, through the communications interface 515 to a wearable device 115, information related to a game. The game can comprise, for example, a Keno game or similar casino game. In other cases, the information can be related to a sporting event or other competitive event. The sports betting instructions 540 can further cause the processor 505 to receive, through the communications interface 515 from the wearable device 115, a message comprising information related to a wager on an outcome of the game. Once the game begins and as it progresses, the sports betting instructions 540 can cause the processor 505 to provide, to the wearable device 115 through the wireless communication interface 515, information comprising a real-time update of a status of the game. The information comprising the real-time update of the status of the game can additionally, or alternatively, comprise a notification that the game has concluded along with an indication of a result of the game.

The memory 510 can additionally or alternatively store a set of venue services instructions 555 which, when executed by the processor 505, can further cause the processor 505 to provide, to the wearable device 115 through the communication interface 515, information related a service of a venue related to the system. This information can comprise, for example, ads for in-venue events and features such as shows, upcoming table game tournaments, EGM tournaments, restaurant menus, etc. The venue services instructions 555 can further cause the processor to receive, from the wearable device 115 through the communication interface 515, a request for the service of the venue, e.g., a request for a restaurant reservation. The venue services instructions 555 can further cause the processor 505 to provide, to the wearable device 115 through the communication interface 515, a notification of an event of a venue related to the system. For example, the notification can comprise notification of an upcoming game or tournament in the venue.

Figure 6:
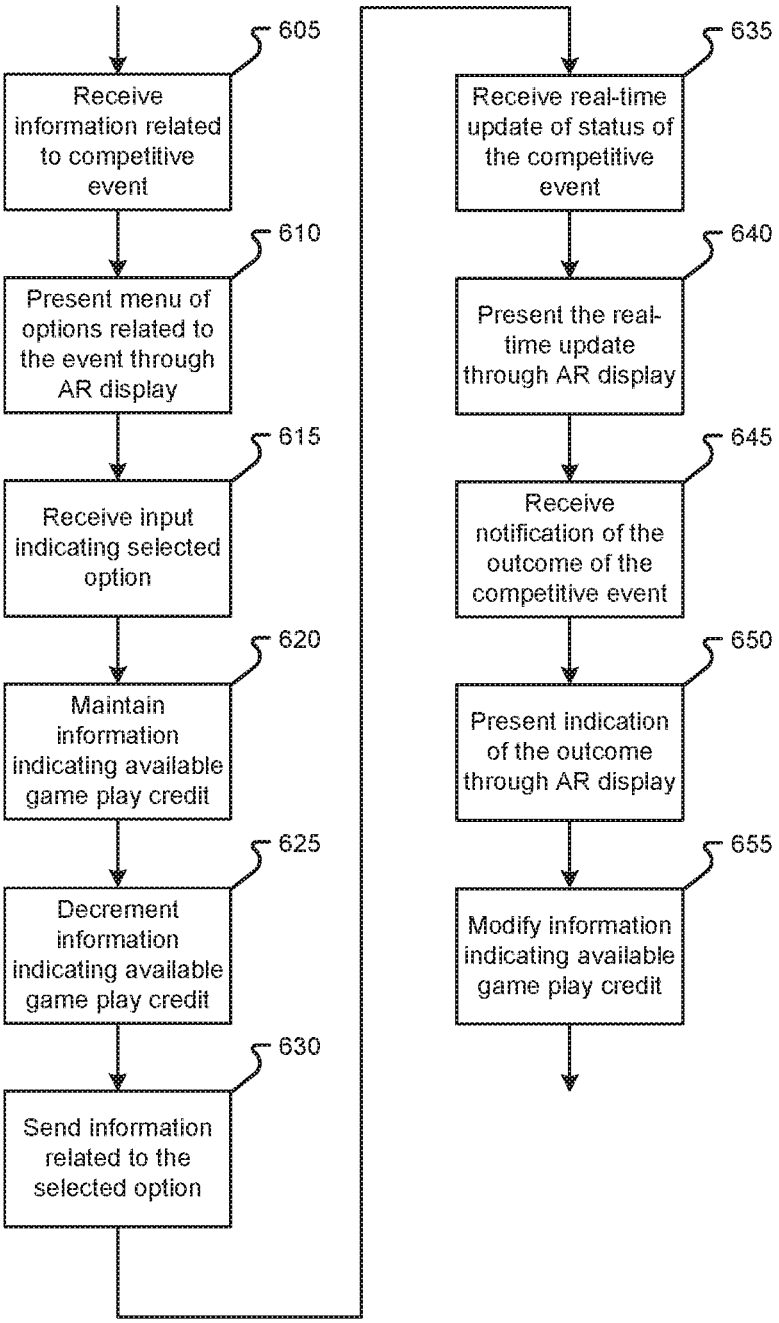
FIG. 6 is a flowchart illustrating an exemplary process for providing augmented reality sports betting and augmented reality features related to a gaming venue according to one embodiment of the present disclosure.

FIG. 6 is a flowchart illustrating an exemplary process for providing augmented reality sports betting and augmented reality features related to a gaming venue according to one embodiment of the present disclosure. More specifically, this example illustrates a process for providing augmented reality sports betting and augmented reality features related to a gaming venue by a wearable device 115 as described herein. As illustrated here, the process can comprise receiving 605, from a gaming system 145 of a gaming venue, information related to one or more competitive events, e.g., sporting events, games, etc.

A menu comprising a set of options related to the competitive events can be presented 610 through the augmented reality display 205 of the wearable device 115. For example, the menu can provide options for selecting one of a number of different competitive events, placing a wager on the selected event, etc. An input can received 615 indicating a selected option from the set of options related to the competitive event. For example, the selected can option comprise an option to place a wager on an outcome of the competitive event. In some cases, the wearable device 115 can maintain 620 information indicating an available game play credit for a user of the wearable device 115. In such cases, the information related to the selected option can comprise an amount of the wager from the available game play credit for the user. If the wager requires payment at this time, the wearable device can decrement 625 the information indicating the available game play credit for the user of the wearable device by at least the amount of the wager. A message comprising information related to the selected option, e.g., the selected competitive event, wager made, indication of payment, etc., can then be sent 630 to the gaming system 145 of the gaming venue.

According to one embodiment, once the competitive event begins and as it continues, the wearable device 115 can receive 635, from the gaming system 145, information comprising real-time updates of a status of the competitive event. For example, the information can indicate a score, current leader, time remaining, textual description of an event such as a score, penalty, change of leader, etc., an audio stream of a play-by-play or other live commentary, a live video stream, an animated representation of the current status of the competitive event, etc. Regardless of its exact form, the received information comprising the real-time update of the status of the competitive event can be present 640 to the user through the augmented reality display 205 of the wearable device 115.

Additionally, or alternatively, once the competitive event has concluded, the wearable device 115 can receive 645 from, the gaming system 145, a notification of the outcome of the competitive event, e.g., a winner, a score, finishing positions, times, etc. This notification can also indicate a result of a wager placed on the competitive event by the user of the wearable device 115. An indication of the outcome of the competitive event can then be presented 650 through the augmented reality display 205 based on this notification. In some cases, the information indicating the available game play credit for the user of the wearable device maintained by the wearable device 115 can be modified 655 based on the outcome of the competitive event and the result of the wager placed on the outcome. For example, if the user wins the wager based on the outcome of the competitive event, the available credits can be incremented to reflect the winnings amount of the wager. In other cases, if the wager is not payable until conclusion of the event and the user loses the wager, the available credits can be decremented accordingly.

Figure 7:
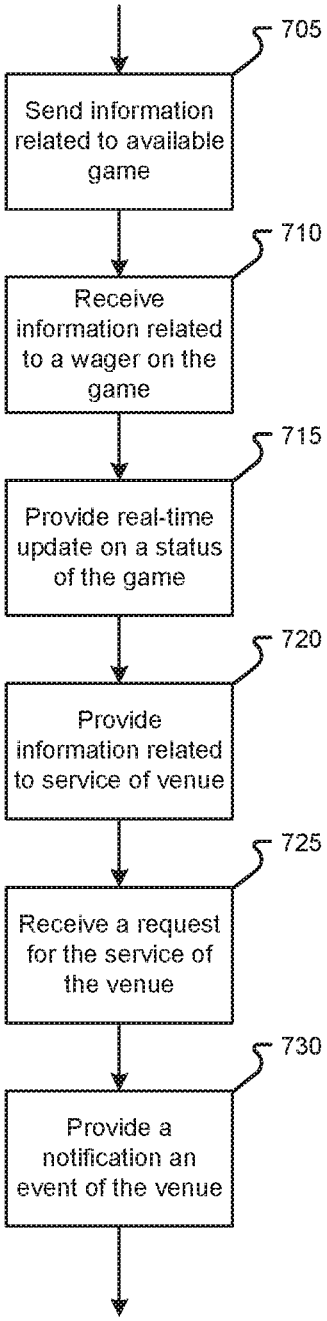
FIG. 7 is a flowchart illustrating an exemplary process for providing augmented reality sports betting and augmented reality features related to a gaming venue according to another embodiment of the present disclosure.

FIG. 7 is a flowchart illustrating an exemplary process for providing augmented reality sports betting and augmented reality features related to a gaming venue according to another embodiment of the present disclosure. More specifically, this example illustrates a process for providing augmented reality sports betting and augmented reality features related to a gaming venue by an EGM 105, gaming system 145, and/or venue system 150 as described herein. As illustrated here, the process can comprise sending 705 information related to a game to a wearable device 115. The game can comprise, for example, a Keno game or similar casino game. In other cases, the information can be related to a sporting event or other competitive event. A message can be received 710 from the wearable device 115, the message comprising information related to a wager on an outcome of the game or competitive event.

During the game or competitive event, the EGM 105 and/or gaming system 145 can provide 715 to the wearable device information comprising a real-time update of a status of the game or competitive event. For example, the update can comprise information indicating a card or number drawn, a score, etc. The information comprising the real-time update of the status of the game can also comprise a notification that the game or competitive event has concluded along with an indication of a result of the game or competitive event.

According to one embodiment, the EGM 105 and/or venue system 150 can provide 720 to the wearable device information related a service of a venue related to the system. For example, the venue system 150 may provide information about restaurants, food or drink menus, schedules for shows, etc. In response, the venue system 150 can receive 725, from the wearable device, a request for the service of the venue related to the system. For example, a drink order or a request for a restaurant reservation may be received. In other cases, the gaming system 145 or venue system 150 can provide 730 to the wearable device 115 a notification of an event of a venue. For example, a notification can be provided that a keno game is about to start. In some cases, the notification of the event can be provided based on a set of preferences for a user of the wearable device. That is, preferences of the user can be used to determine which events or types of events may be of interest to the user.

Figure 8:
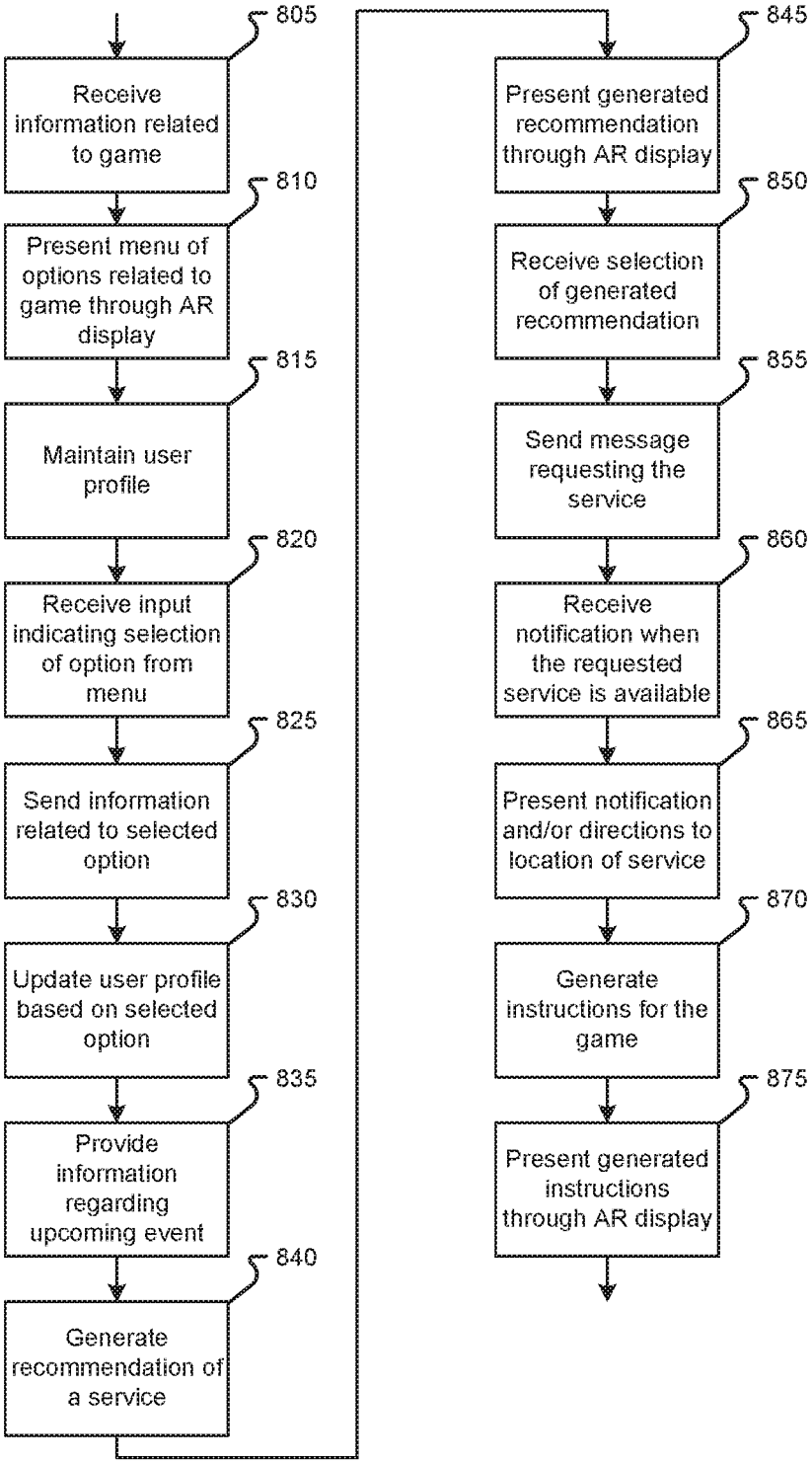
FIG. 8 is a flowchart illustrating an exemplary process for providing augmented reality sports betting and augmented reality features related to a gaming venue according to yet another embodiment of the present disclosure.

FIG. 8 is a flowchart illustrating an exemplary process for providing augmented reality sports betting and augmented reality features related to a gaming venue according to yet another embodiment of the present disclosure. More specifically, this example illustrates a process for providing augmented reality sports betting and augmented reality features related to a gaming venue by a wearable device 115 as described herein. As illustrated here, the process can comprise receiving 805 by a wearable device 115 from an EGM 105 or gaming system 145 of a gaming venue, information related to a game provided within the gaming venue. For example, the information can identify a game such as keno available within the gaming venue. In some case, the information can additionally or alternatively comprise information about a competitive event as described above. In either case, the wearable device 115 can present 810, through the augmented reality display 205, a menu comprising a set of options related to the game or competitive event.

According to one embodiment, the wearable device 115 can maintain 815 a user profile for a user of the wearable device. The user profile can define a set of preferences for the user, e.g., favorite games, favorite sports teams or players, etc. An input indicating a selected option of the set of options can be received 820 by the wearable device 115. For example, the input can indicate a selection of an available game, a wager placed, etc. A message comprising information related to the selected option can be sent 825 by the wearable device 115 to the gaming system 145. The wearable device 115 can also update 830 the user profile based on the selected option.

Based on the user preferences and other information of the user profile, the wearable device 115 can provide 835 information to the user regarding an upcoming event of potential interest to the user. For example, the wearable device can obtain from the gaming system 145 information about available games and competitive events and present to the user an indication when a favored game is available, team is playing, etc. Additionally, or alternatively, the wearable device 115 can generate 840 a recommendation of a service of the gaming venue for the user based on the user profile. For example, the wearable device can receive information of available services from the venue systems 150 and make a recommendation of a bar or restaurant available in the gaming venue based on food or beverage preferences indicated in the user profile.

In either case, the wearable device 115 can present 845 the information or recommendations through the augmented reality display and receive 850 an indication of selection of the information or generated recommendation by the user of the wearable device. For example, the selection may indicate a request for a game, an order of food or drink, a request for a reservation at a restaurant or gaming table, etc. The wearable device 115 can the send 855, to the gaming system 145 or venue system, depending on the selection made, a message requesting the service of the gaming venue and receive 860 a notification when the requested service of the gaming venue is available. In some cases, and according to one embodiment, the wearable device 115 can then present 865, through the augmented reality display 205, directions to a location in the gaming venue for the requested service, e.g., in the form of turn-by-turn navigation instruction overlays in the augmented reality display 205 to guide the user to the selected bar, restaurant, game, etc. According to one embodiment, when the selection indicates a request for a game, the wearable device 115 may generate 870 a set of instructions for the game and present 875, through the augmented reality display 205, the generated set of instructions for the game.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention is claimed as follows:

1. A wearable device comprising:

a wireless communications interface;

an augmented reality display;

an input device;

a processor coupled with the wireless communications interface, the augmented reality display, and the input device; and a memory coupled with and readable by the processor and storing therein a set of instructions which, when executed by the processor, causes the processor to:

receive, through the wireless communications interface from a gaming system of a gaming venue, information related to a competitive event;

present, through the augmented reality display, a menu comprising a set of options related to the competitive event;

receive, from the input device an input indicating a selected option from the set of options related to the competitive event;

send, to the gaming system of the gaming venue, a message comprising information related to the selected option;

maintain a user profile for a user of the wearable device, the user profile defining a set of preferences for the user;

update the user profile based on the selected option;

provide, through the augmented reality display, information to the user regarding an upcoming event of potential interest to the user based on the user preferences;

generate a recommendation of a service of the gaming venue for the user of the wearable device based on the user profile; and present, through the augmented reality display, the generated recommendation of the service of the gaming venue.

2. The wearable device of claim 1, wherein the selected option comprises an option to place a wager on an outcome of the competitive event.

3. The wearable device of claim 2, wherein the set of instructions further causes the processor of the wearable device to maintain, in cooperation with the memory, information indicating an available game play credit for a user of the wearable device.

4. The wearable device of claim 3, wherein the information related to the selected option comprises an amount of the wager from the available game play credit for the user of the wearable device and wherein the set of instructions further causes the processor of the wearable device to decrement the information indicating the available game play credit for the user of the wearable device by at least the amount of the wager.

5. The wearable device of claim 4, wherein the set of instructions further causes the processor to:

receive, from the gaming system through the wireless communications interface, a notification of the outcome of the competitive event;

present, through the augmented reality display, an indication of the outcome of the competitive event; and modify the information indicating the available game play credit for the user of the wearable device maintained by the processor of the wearable device based on the outcome of the competitive event and the wager placed on the outcome.

6. The wearable device of claim 1, wherein the set of instructions further causes the processor to:

receive, from the gaming system through the wireless communications interface, information comprising a real-time update of a status of the competitive event; and present, through the augmented reality display, the received information comprising the real-time update of the status of the competitive event.

7. The wearable device of claim 6, wherein the information comprising the real-time update of the status of the competitive event comprises a live video stream.

8. A system comprising:

a gaming system comprising a communications interface coupled with a communications network, a processor, coupled with the communications interface and a memory coupled with and readable by the processor and storing therein a set of instructions which, when executed by the processor, causes the processor to:

send, through the communications interface to a wearable device, information related to a game, receive, through the communications interface from the wearable device, a message comprising information related to a wager on an outcome of the game, and provide, to the wearable device through the communications interface, information comprising a real-time update of a status of the game; and the wearable device comprising a wireless communications interface, an augmented reality display, an input device, a processor coupled with the wireless communications interface, the augmented reality display, and the input device, and a memory coupled with and readable by the processor and storing therein a set of instructions which, when executed by the processor, causes the processor to:

receive, through the wireless communications interface, the information related to the game;

present, through the augmented reality display, a menu comprising a set of options related to the game;

receive, from the input device an input indicating a selected option from the set of options related to the game;

send, to the gaming system of the gaming venue, the message comprising information related to the wager on the outcome of the game based on the selected option;

maintain a user profile for a user of the wearable device, the user profile defining a set of preferences for the user;

update the user profile based on the selected option;

provide, through the augmented reality display, information to the user regarding an upcoming event of potential interest to the user based on the user preferences;

generate a recommendation of a service of the gaming venue for the user of the wearable device based on the user profile; and present, through the augmented reality display, the generated recommendation of the service of the gaming venue.

9. The system of claim 8, wherein the information comprising the real-time update of the status of the game comprises a notification that the game has concluded and an indication of a result of the game.

10. The system of claim 8, wherein the set of instructions further causes the processor of the gaming system to provide, to the wearable device through the communications interface, information related to a service of a venue related to the system.

11. The system of claim 10, wherein the set of instructions further causes the processor of the gaming system to receive, from the wearable device through the communications interface, a request for the service of the venue related to the system.

12. The system of claim 8, wherein the set of instructions further causes the processor of the gaming system to provide, to the wearable device through the communications interface, a notification of an event of a venue related to the system.

13. The system of claim 12, wherein the providing the notification of the event is further based on a set of preferences for a user of the wearable device.

14. A method comprising:

receiving, by a wearable device from a gaming system of a gaming venue, information related to a game provided within the gaming venue;

presenting, by the wearable device through an augmented reality display, a menu comprising a set of options related to the game;

receiving, by the wearable device, an input indicating a selected option of the set of options related to the game;

sending, by the wearable device to the gaming system of the gaming venue, a message comprising information related to the selected option;

maintaining, by the wearable device, a user profile for a user of the wearable device, the user profile defining a set of preferences for the user;

updating, by the wearable device, the user profile based on the selected option;

providing, by the wearable device, information to the user regarding an upcoming event of potential interest to the user based on the user preferences;

generating, by the wearable device, a recommendation of a service of the gaming venue for the user of the wearable device based on the user profile; and presenting, by the wearable device through the augmented reality display, the generated recommendation of the service of the gaming venue.

15. The method of claim 14, further comprising:

receiving, by the wearable device, an indication of selection of the generated recommendation by the user of the wearable device;

sending, by the wearable device to the gaming system, a message requesting the service of the gaming venue; and receiving, by the wearable device from the gaming system, a notification when the requested service of the gaming venue is available.

16. The method of claim 15, further comprising:

presenting, by the wearable device through the augmented reality display, directions to a location in the gaming venue for the requested service.

17. The method of claim 14, further comprising:

generating, by the wearable device, a set of instructions for the game; and presenting, by the wearable device through the augmented reality display, the generated set of instructions for the game.

* * * * *